US011492733B2

(12) United States Patent
McCaffrey

(10) Patent No.: US 11,492,733 B2
(45) Date of Patent: Nov. 8, 2022

(54) WEAVE CONTROL GRID

(71) Applicant: United Technologies Corporation, Farmington, CT (US)

(72) Inventor: Michael G. McCaffrey, Windsor, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 261 days.

(21) Appl. No.: 16/798,023

(22) Filed: Feb. 21, 2020

(65) Prior Publication Data

US 2021/0262126 A1 Aug. 26, 2021

(51) Int. Cl.

*D03D 23/00* (2006.01)
*D03D 41/00* (2006.01)
*D03D 49/02* (2006.01)

(52) U.S. Cl.

CPC ..... *D03D 23/00* (2013.01); *D03D 41/004* (2013.01); *D03D 49/02* (2013.01); *D03D 41/007* (2013.01)

(58) Field of Classification Search

CPC .... D03D 41/004; D03D 25/005; D03D 23/00; D03D 49/02; D03D 41/007

See application file for complete search history.

(56) References Cited

U.S. PATENT DOCUMENTS 3,584,658 A * 6/1971 Ferreirinha ..... D03D 37/00 139/16
3,717,012 A * 2/1973 Misner ..... D04C 3/00 66/1 A
4,007,882 A * 2/1977 Isoard ..... B65H 67/04 242/473.7
4,019,540 A * 4/1977 Holman ..... D03D 41/004 139/20
4,080,915 A * 3/1978 Bompard ..... B29C 70/24 112/412
4,095,619 A * 6/1978 Kallmeyer ..... D03D 41/004 139/140
4,160,467 A * 7/1979 Woodruff ..... D03D 29/00 139/33
4,162,562 A * 7/1979 Beauregard ..... D03D 29/00 139/34

(Continued)

FOREIGN PATENT DOCUMENTS

WO 2008018438 A1 2/2008
WO 2014011380 A1 1/2014

OTHER PUBLICATIONS

European Search Report for European Application No. 21158531.0; Application Filing Date: Feb. 22, 2021; dated Jul. 1, 2021; Date Received: Jul. 15, 2021; 9 pages.

*Primary Examiner* — Robert H Muromoto, Jr.
(74) *Attorney, Agent, or Firm* — Cantor Colburn LLP

(57) ABSTRACT

Disclosed is a weaving method including placing a first section of a fill fiber between warp fibers, forming a pick, moving a base to reposition the warp fibers, and placing a second section of the fill fiber between the warp fibers to form a woven structure, wherein at least a portion of the warp fibers are introduced to the woven structure using a weave control grid. Also disclosed is a weaving assembly including a base, a base positional controller, a weave control grid, warp fiber arms, a warp fiber arm positional controller and a fill fiber wand.

16 Claims, 6 Drawing Sheets

(56) References Cited

U.S. PATENT DOCUMENTS 4,644,619 A * 2/1987 Cahuzac ..... D03D 41/004 28/100
4,656,703 A * 4/1987 Cahuzac ..... D03D 41/004 28/100
4,719,837 A * 1/1988 McConnell ..... B29C 70/24 87/1
4,846,229 A * 7/1989 Starlinger-Huemer ..... D03C 7/00 139/457
5,178,193 A * 1/1993 Sato ..... B65H 59/04 139/16
5,350,139 A * 9/1994 Leyderman ..... B28B 21/86 249/177
5,431,193 A * 7/1995 Mood ..... D03D 41/004 139/11
5,435,048 A * 7/1995 Walker ..... D03D 29/00 28/149
5,794,885 A * 8/1998 Husek ..... D03D 49/20 139/304
6,418,974 B1 * 7/2002 King ..... B01D 46/0001 139/383 R
7,658,210 B1 * 2/2010 Nyce ..... D03D 41/00 139/29
7,713,893 B2 * 5/2010 Goering ..... B32B 3/263 442/246
8,105,019 B2 * 1/2012 McCaffrey ..... F01D 17/162 415/160
8,206,118 B2 * 6/2012 Propheter-Hinckley ..... F01D 5/3092 416/219 R
8,600,541 B2 * 12/2013 Shan ..... D04H 3/04 700/131
8,939,728 B2 * 1/2015 McCaffrey ..... B28B 1/14 416/230
9,212,560 B2 * 12/2015 McCaffrey ..... F01D 5/284
9,409,356 B2 * 8/2016 Karb ..... B29C 70/382
9,725,833 B2 * 8/2017 Hasko ..... D03D 23/00
10,024,173 B2 * 7/2018 McCaffrey ..... F01D 5/147
10,036,281 B2 * 7/2018 McCaffrey ..... F01D 25/246
10,081,892 B2 * 9/2018 Kirkpatrick ..... B29B 11/16
10,174,624 B1 * 1/2019 McCaffrey ..... B32B 18/00
10,294,166 B2 * 5/2019 McCaffrey ..... C04B 35/80
10,309,230 B2 * 6/2019 McCaffrey ..... F01D 5/28
10,358,929 B2 * 7/2019 McCaffrey ..... F01D 5/282
10,507,515 B2 * 12/2019 Carr ..... B22C 1/00
10,724,387 B2 * 7/2020 Farrar ..... F01D 9/041
10,801,349 B2 * 10/2020 McCaffrey ..... F01D 25/24
10,815,810 B2 * 10/2020 Barker ..... F01D 11/005
10,870,200 B2 * 12/2020 Kayser ..... B25J 5/04
11,041,397 B1 * 6/2021 McCaffrey ..... F01D 11/003
11,047,245 B2 * 6/2021 McCaffrey ..... F01D 5/3053
11,125,093 B2 * 9/2021 Dube ..... F01D 9/041
11,143,040 B2 * 10/2021 McCaffrey ..... F01D 5/282
11,193,376 B2 * 12/2021 McCaffrey ..... F01D 5/22
2001/0015510 A1 * 8/2001 Nakamura ..... B29C 31/002 264/159
2002/0032479 A1 * 3/2002 Hankh ..... D04C 1/06 623/1.16
2002/0160068 A1 * 10/2002 Nakamura ..... B29C 53/828 425/112
2003/0175453 A1 * 9/2003 Steffier ..... F02K 9/64 428/34.5
2006/0085960 A1 * 4/2006 O'Keefe ..... D04D 1/04 29/241
2006/0121809 A1 * 6/2006 Goering ..... B29C 70/24 442/246
2009/0148282 A1 * 6/2009 McCaffrey ..... F01D 17/162 415/208.2
2010/0284816 A1 * 11/2010 Propheter-Hinckley ..... F01D 5/3092 416/241 B
2011/0283871 A1 * 11/2011 Adams ..... A61F 2/90 87/9
2012/0275898 A1 * 11/2012 McCaffrey ..... F01D 11/18 415/1
2013/0004325 A1 * 1/2013 McCaffrey ..... C04B 35/584 416/241 B
2013/0004326 A1 * 1/2013 McCaffrey ..... C04B 37/003 416/241 B
2013/0052030 A1 * 2/2013 McCaffrey ..... C04B 35/80 416/241 B
2013/0094951 A1 * 4/2013 McCaffrey ..... F01D 25/246 415/200
2013/0142660 A1 * 6/2013 McCaffrey ..... F01D 5/18 416/241 B
2013/0323073 A1 * 12/2013 McCaffrey ..... C04B 37/001 416/241 B
2014/0014223 A1 * 1/2014 Hasko ..... D03D 23/00 139/35
2014/0110063 A1 * 4/2014 Mathon ..... B29C 53/562 156/446
2015/0042023 A1 * 2/2015 McCaffrey ..... B28B 23/02 264/632
2015/0210240 A1 * 7/2015 Tanaka ..... D06N 3/128 442/189
2015/0377067 A1 * 12/2015 McCaffrey ..... F01D 25/246 415/200
2016/0017723 A1 * 1/2016 McCaffrey ..... F01D 5/3007 415/200
2016/0053619 A1 * 2/2016 McCaffrey ..... C04B 37/003 416/229 A
2016/0160658 A1 * 6/2016 McCaffrey ..... F04D 29/388 415/200
2016/0167112 A1 * 6/2016 Carr ..... B22D 29/002 415/115
2017/0362753 A1 * 12/2017 Le Costaouec ..... C04B 41/4554
2018/0057979 A1 * 3/2018 Kirkpatrick ..... D04H 1/43
2019/0136425 A1 * 5/2019 Le Costaouec ..... C04B 41/4554
2019/0284731 A1 * 9/2019 Oberste ..... D03C 3/205
2021/0262353 A1 * 8/2021 McCaffrey ..... B32B 3/04
2021/0363674 A1 * 11/2021 McCaffrey ..... D03D 41/004

* cited by examiner

WEAVE CONTROL GRID

BACKGROUND

Exemplary embodiments of the present disclosure pertain to the art of robotic weaving of structures having varying contours.

Woven structures are known. Woven structures are made of multiple picks along the formation direction. In some traditional weaving techniques, the term "pick" describes one fill fiber that has been deposited and encapsulated by the entire array of warp fibers one row at a time. The term "pick" may apply to encapsulation of the fill fiber by one adjacent pair of warp fibers at a time.

Many components, such as ceramic matrix composite (CMC) or organic matrix composite (OMC) components used in a jet engine, use woven structures as preforms. The woven structure strengthens the component. During manufacturing of such components, the woven structure is placed in a mold as a precursor. A material is then injected into the remaining areas of the mold. The injected material or resin surrounds the woven structure within the mold. If the mold has varying contours, manipulating woven assemblies, which are relatively planar, into a shape suitable for placing into the mold is difficult. Methods for forming three dimensional woven structures are desired.

BRIEF DESCRIPTION

Disclosed is a weaving method including placing a first section of a fill fiber between warp fibers, forming a pick, moving a base to reposition the warp fibers, and placing a second section of the fill fiber between the warp fibers to form a woven structure, wherein at least a portion of the warp fibers are introduced to the woven structure using a weave control grid.

In addition to one or more of the features described above, or as an alternative to any of the foregoing embodiments, the method may secure at least a portion of the warp fibers to the base.

In addition to one or more of the features described above, or as an alternative to any of the foregoing embodiments, the weave control grid is affixed to the base.

In addition to one or more of the features described above, or as an alternative to any of the foregoing embodiments, the weave control grid is slidably located below the fill fiber.

In addition to one or more of the features described above, or as an alternative to any of the foregoing embodiments, the weave control grid has a central opening.

Also disclosed is a weaving method including forming a first pick, repositioning warp fibers by moving warp fiber arms relative to a fill fiber wand, repositioning warp fibers by moving a base relative to the fill fiber wand, or both and forming a second pick after repositioning warp fibers to produce a woven structure. At least a portion of the warp fibers extend from one of the warp fiber arms to the base and at least a portion of the warp fibers are introduced to the woven structure using a weave control grid.

In addition to one or more of the features described above, or as an alternative to any of the foregoing embodiments, the method further includes repositioning the weave control grid relative to the fill fiber wand.

In addition to one or more of the features described above, or as an alternative to any of the foregoing embodiments, warp fibers are positioned by the weave control grid prior to forming the first pick or second pick.

In addition to one or more of the features described above, or as an alternative to any of the foregoing embodiments, the weave control grid is attached to the base.

Also disclosed is a weaving assembly comprising a base, a base positional controller, a weave control grid, warp fiber arms, a warp fiber arm positional controller and a fill fiber wand.

In addition to one or more of the features described above, or as an alternative to any of the foregoing embodiments, the weaving assembly further includes a holding station. The holding station may be a secondary weave control grid.

In addition to one or more of the features described above, or as an alternative to any of the foregoing embodiments, the weave control grid has an open central section.

In addition to one or more of the features described above, or as an alternative to any of the foregoing embodiments, the weave control grid is slidably located below the fill fiber wand.

In addition to one or more of the features described above, or as an alternative to any of the foregoing embodiments, the weave control grid location is controlled by a positional controller.

In addition to one or more of the features described above, or as an alternative to any of the foregoing embodiments, the weave control grid is modular.

In addition to one or more of the features described above, or as an alternative to any of the foregoing embodiments, the weave control grid has openings with variable spacing between openings.

In addition to one or more of the features described above, or as an alternative to any of the foregoing embodiments, the weaving assembly further includes additional weave control grids.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed assembly and method are presented herein by way of exemplification and not limitation with reference to the Figures.

Figure 1:
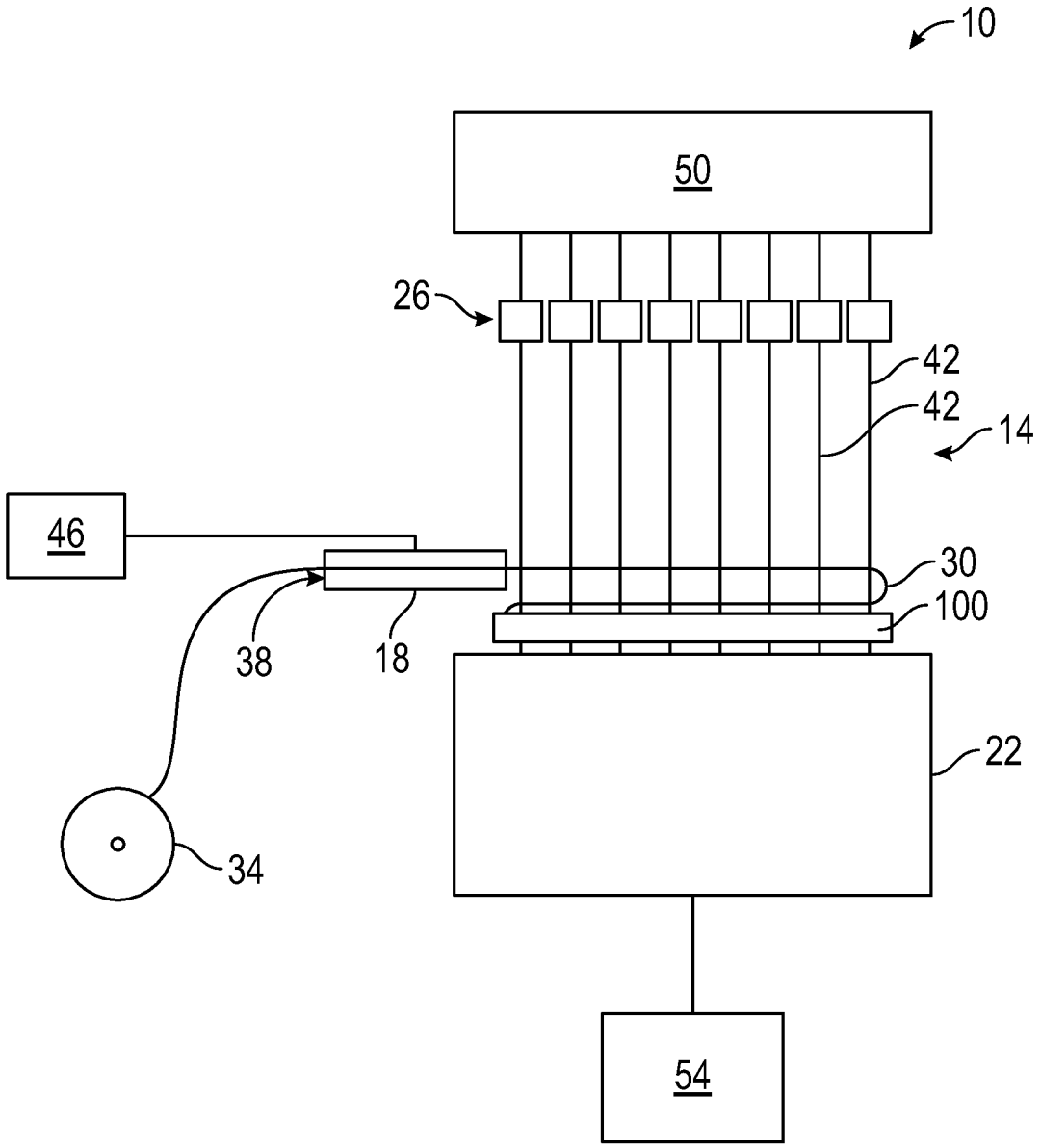
FIG. 1 shows a schematic view of an example weaving assembly.
Figure 2A:
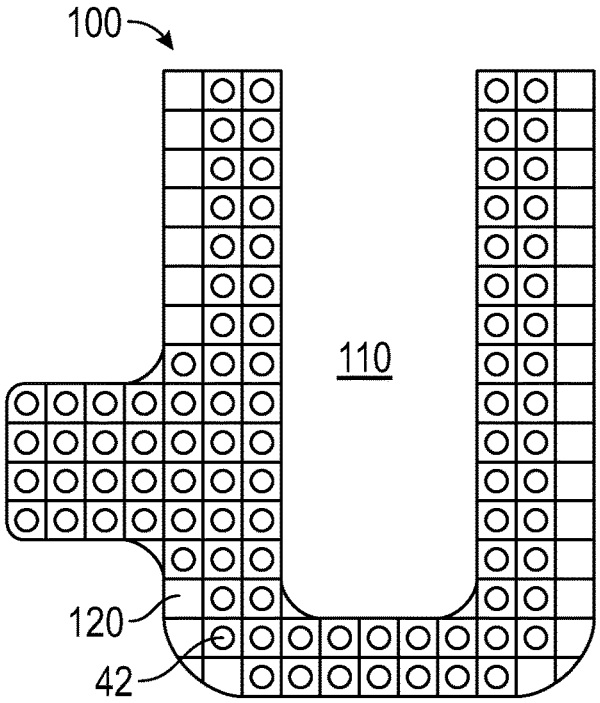
FIGS. 2A-C shows a schematic view of a weave control grid and the progression of warp fiber introduction.
Figure 8:
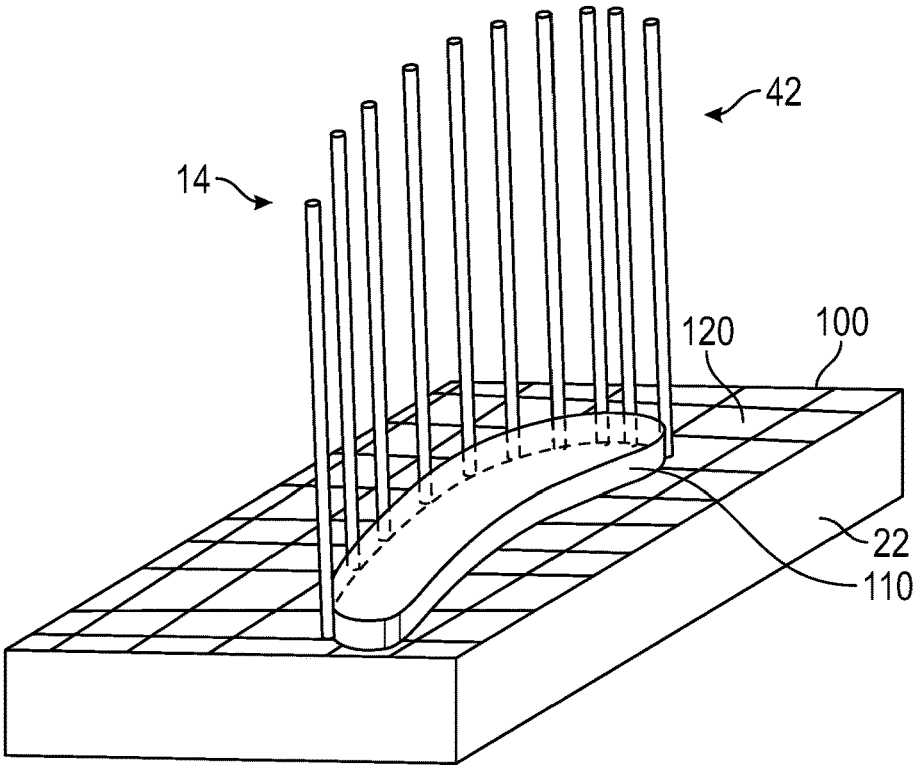
FIG. 8 shows a perspective close-up view of a base of the FIG. 1 weaving assembly and weave control grid 100, showing discrete warp fibers attached, prior to weaving the structure of FIG. 2.
Figure 9:
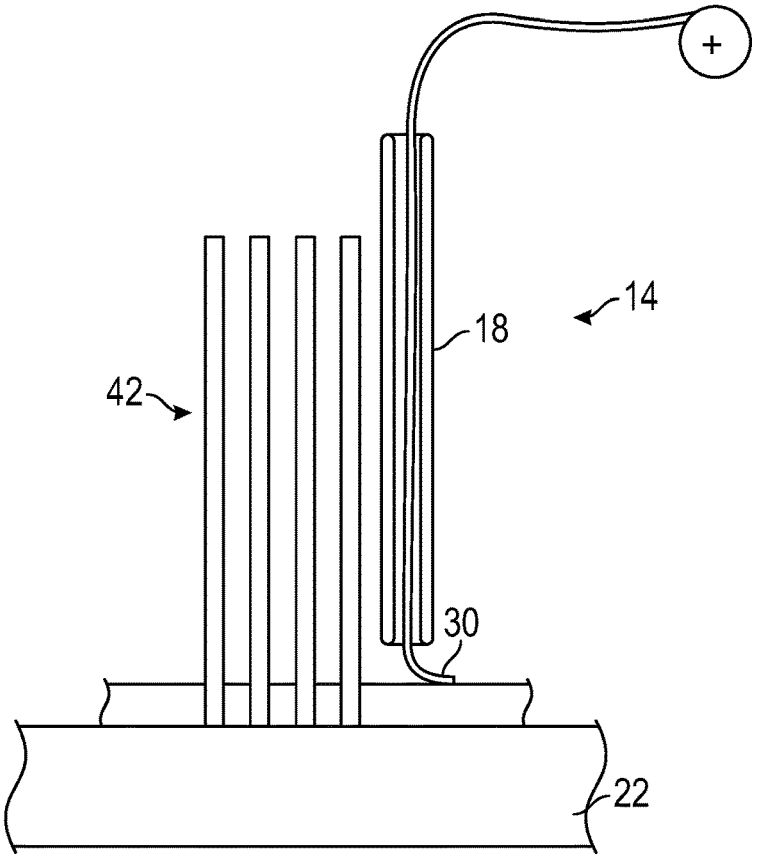
FIG. 9 shows a side view of a base of the FIG. 1 weaving assembly when weaving the structure of FIG. 2.

Referring to FIG. 1, an example weaving assembly 10 is used to weave a woven structure 14. The weaving assembly 10 includes a wand 18, a base 22, weave control grid 100, and a plurality of warp fiber arms 26. The weave control grid is shown in FIG. 2A and FIG. 8.

When weaving the woven structure 14, the wand 18 positions a fill fiber 30 between warp fibers 42. Controlled spacing of the warp fibers is important to consistent production of the woven structure. The fill fiber 30 extends from a spool 34 through a bore 38 in the wand 18. The wand 18, in this example, is a hollow tube. A fill fiber feed device may be included to meter the feed rate of the fill fiber with respect to the instantaneous relative velocity of the wand tip to the textile being created. The warp fibers 42 are manipulated by warp fiber arms 26.

The assembly 10 includes a positional controller 46 associated with the wand 18, a positional controller 50 associated with the warp fiber arms 26, and a positional controller 54 associated with the base 22. The positional controller 46 is able to move the wand 18 relative to the warp fiber arms 26 and the base 22. The positional controller 50 is able to move the warp fiber arms 26 relative to the wand 18 and the base 22. The positional controller 54 is able to move the base 22 relative to the wand 18 and the warp fiber arms 26. The positional controllers 46, 50, and 54 can be operated independently from each other or together.

The warp fiber arms 26 may be on the positional controller 50, attached to the fill fiber wand controller 46, or attached to the base positional controller 54.

In this example, at least the positional controller 54 is a six-axis controller, and may be a six-axis robotic controller. That is, the positional controller 54 is able to move the base 22 relative to the warp fiber arms 26 in three dimensions and rotate around three axes. The positional controllers 46 and 50 may have similar characteristics.

Figure 2B:
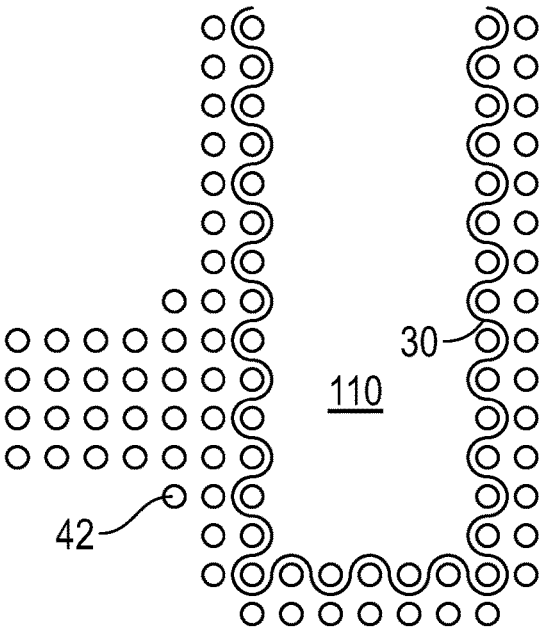
Figure 2C:
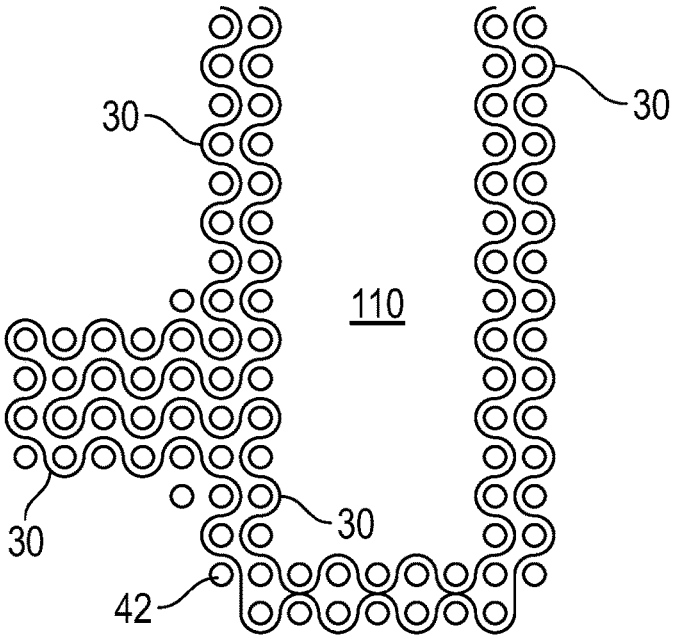
Figure 3:
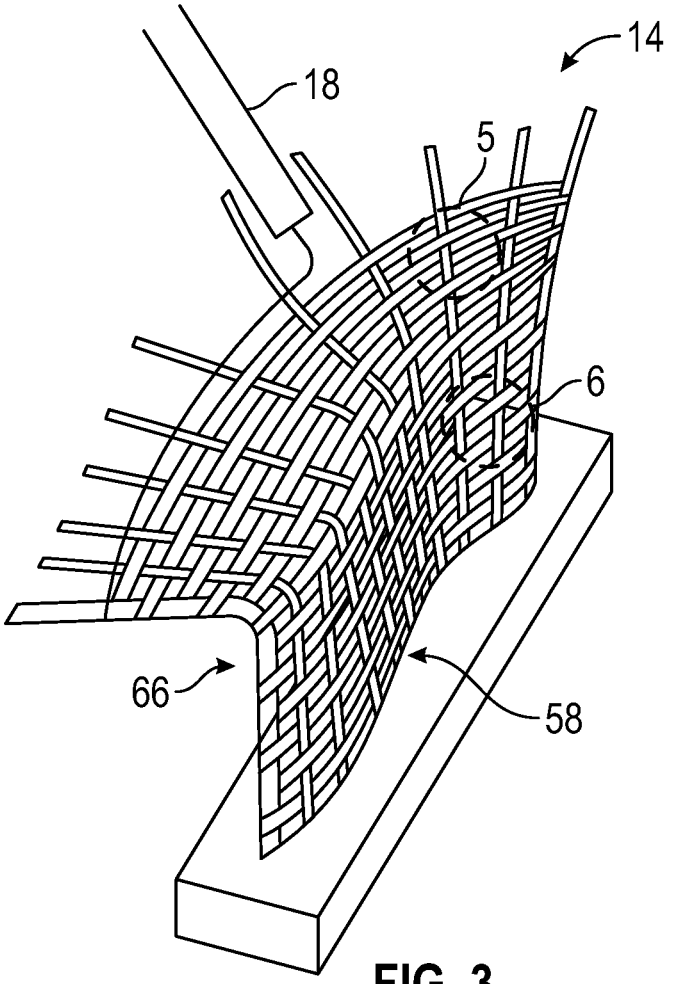
FIG. 3 shows a perspective view of a portion of the FIG. 1 weaving assembly having a partially finished woven structure.
Figure 4:
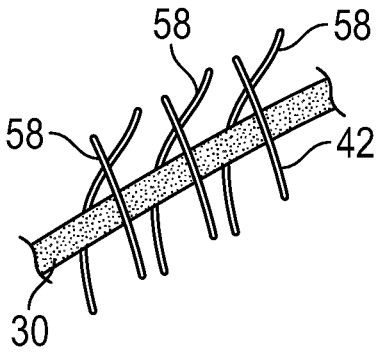
FIG. 4 shows a view of several picks.
Figure 5:
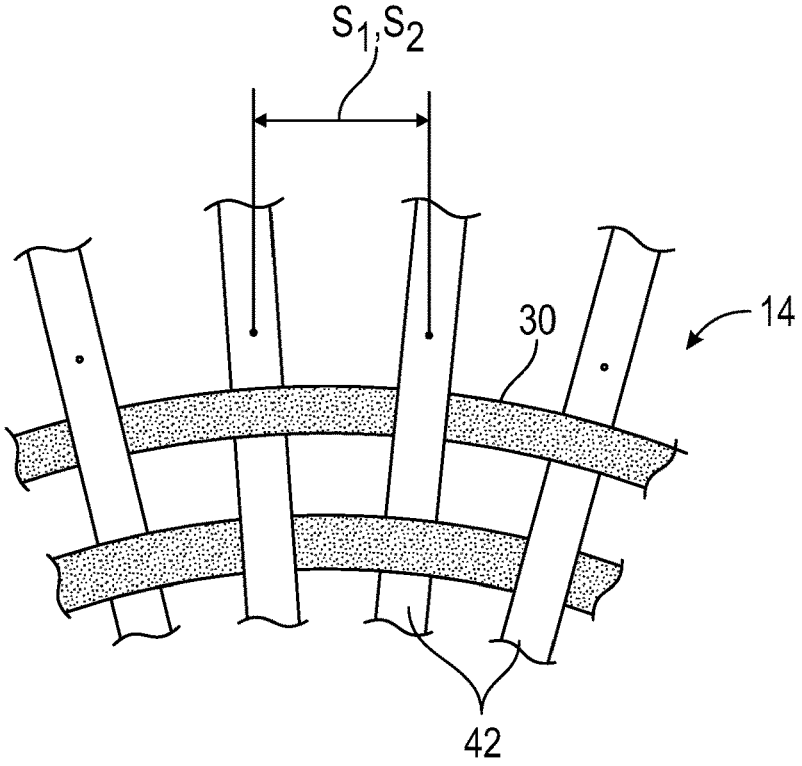
FIG. 5 shows a close-up view of an Area 5 of the woven structure during the weaving.
Figure 6:
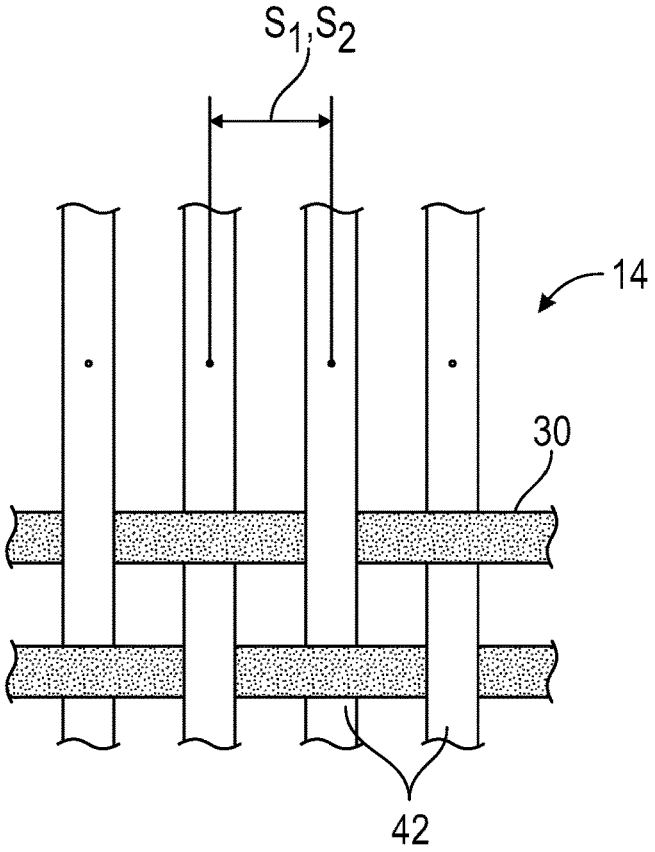
FIG. 6 shows a close-up view of an Area 6 of the woven structure during the weaving.
Figure 7:
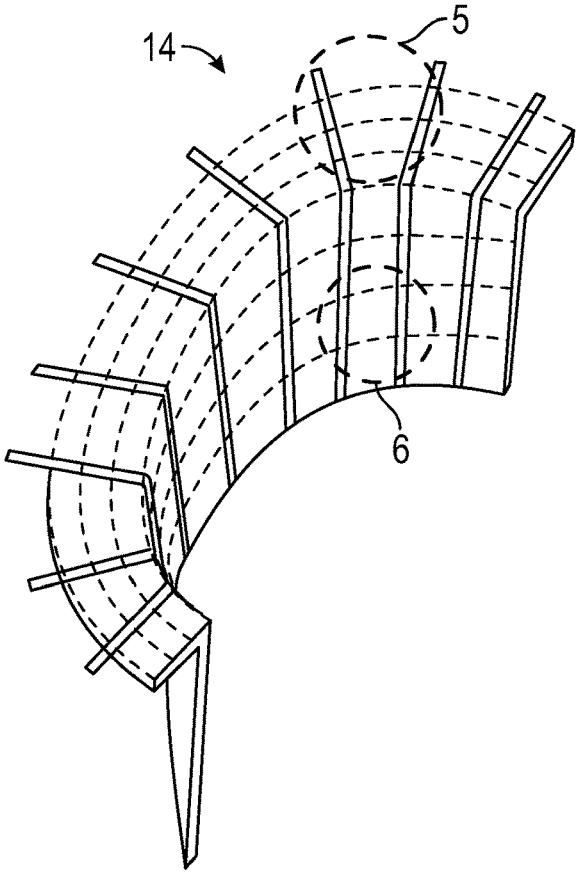
FIG. 7 shows an example finished woven structure.

Referring to FIGS. 2A-C, the assembly 10 further includes a weave control grid 100 to position the warp fibers in close proximity to the desired position for weaving and with controlled spacing. Locating the warp fibers in close proximity to the desired position for incorporation into weaving and with controlled spacing results in a more consistent and precise woven structure with better reproducibility of physical characteristics between woven structures. The term "grid" as used herein describes a distribution pattern of openings with designated spacing. The desired spacing between grid openings may vary as needed to locate warp fibers in close proximity to the desired location for incorporation into weaving. For example, if adding a number of warp fibers in a small area the grid spacing may be smaller whereas in areas where fibers are being added over a larger area the spacing may be larger. The grid openings may be any shape or size that will permit the fibers to pass through.

The weave control grid 100 can be affixed to the base 22 as shown in FIG. 8 or can be slidably located below the addition point of the fill fiber from the wand 18. When affixed to the base the weave control grid 100 may have an open central section 110 to accommodate the initial warp fibers attached to the base and a plurality of warp fiber openings 120 which include openings for warp fibers to be added during changes in contour and/or size of the woven structure.

FIG. 2A is a top view that shows the weave control grid 100 with fiber openings 120 and warp fibers 42 located in some of the openings. Fiber openings 120 are shown as square but may be any shape that will accommodate the warp fiber. The fiber openings 120 may also vary in size to more precisely locate specific fibers. The spacing between the openings is dependent upon the weave design.

FIG. 2B is a top view that shows the fill fiber 30 woven through a portion of the warp fibers 42. FIG. 2C is a top view showing the fill fiber 30 woven through the warp fibers as in FIG. 2B and additional warp fibers.

When the weave control grid is slidably located below the addition point of the fill fiber wand the weave control grid has an open central section to accommodate the evolving woven structure. It is further contemplated that the weave control grid may be modular to permit changes to the size and shape of the central opening to accommodate changes in the size and shape of the evolving woven structure. When the weave control grid is slidably located the weave control grid may associated with a positional controller which is able to move the weave control grid relative to the fill fiber wand.

Referring to FIGS. 3-9 with continuing reference to FIGS. 1 and 2A-C, the woven structure 14 includes multiple picks 58. In this example, warp fibers 42 are crossed over multiple sections of the fill fiber 30 to form picks 58. The warp fiber arms 26 are actuated to cross the warp fibers 42 over the fill fiber 30, which entraps the fill fiber to form the pick 58.

The example fill fibers 30 and warp fibers 42 may be composed of materials including glass, graphite, polyethylene, aramid, ceramic, boron and combinations thereof. One of the fill fibers 30 or warp fibers 42 may include hundreds or thousands of individual filaments. The individual filaments may have diameters that range from 5 to 25 microns, although boron filaments may be up to 142 microns in diameter.

In this example, each of the warp fiber arms 26 holds one of the warp fibers 42. In other examples, the warp fiber arms 26 may hold several of the warp fibers 42. After crossing the warp fibers 42 over the fill fiber 30, the warp fiber arms 26 hand-off the warp fiber 42 to another of the warp fiber arms 26. The "hand-off" feature allows an open shed so that the warp fiber arms 26 do not interfere with the wand 18. After the hand-off, the warp fiber arms 26 are then crossed over another section of the fill fiber 30 to form another pick 58.

The warp fiber arms 26 engage portions of the warp fibers 42. These portions may include end fittings. The warp fiber arms 26 grab the end fittings holding the warp fibers 42. The end fittings may be placed on a holding station to help maintain the position of the warp fibers 42 during weaving. In some embodiments the holding station has the form of a secondary weave control grid.

A person having skill in this art and the benefit of this disclosure would understand how to create picks by crossing warp fibers over a fill fiber, and how to hand-off a warp fiber from one warp fiber arm to another warp fiber arm.

When weaving, the wand 18 moves the fill fiber 30 past the warp fibers 42. The wand 18 moves the fill fiber 30 back and forth to create built-up layers of picks 58. The wand 18 is long enough to reach down through the longest warp fibers 42 during the weaving (FIG. 8).

The base 22 is moved as dictated by the design of the woven structure 14 to create a bend 66 in the woven structure 14. The base 22 is thus capable of movement relative to the warp fiber arms 26.

The base 22 moves so that the pick formation point is at a position relative to the wand 18, and the fill fiber 30, appropriate for forming the bend 66. Although only one substantial bend 66 is shown, the base 22 may manipulate the pick formation points to form a woven structure having various contours.

The base 22 may move the warp fibers 42 over a piece of tooling shaped to the final desired contour [e.g., a mandrel] that is attached to the base 22 to facilitate forming the bend 66. The mandrel may move separately from the base 22. In another example, the base 22 moves the warp fibers 42 without a mandrel to free-form the bend 66.

The warp fibers 42 may be rigid enough to cantilever out from the base 22 (or shed) during the weaving. A binding agent such as polyvinyl alcohol is used, in some examples, to provide a degree of rigidity to the warp fibers 42. The warp fibers 42 may have a fixed length. The fill fiber 30, by contrast, can have length in excess of that needed to produce one component.

Alternatively, the warp fibers 42 may be soft and not rigid enough to cantilever out from the base. In other examples, metallic or plastic fittings may be added to the free ends of flexible warp fibers 42. The fittings may be placed in holding stations, and the warp arms move the fittings from notch to notch as appropriate as the component is build up.

The fittings may take the form of a bead with a through-hole. Prior to weaving, the ends of the warp fibers 42 are inserted through the holes and bonded with an adhesive. The holding station may be a fixture that has notches to hold the non-rigid warp fibers by draping the fitting over the notch and having gravity provide tension. The fittings may also take the form of mechanisms that provide tension by the action of a spring, similar to carriers that hold spools of fiber on a braiding machine. The holding station may be attached to the base or may be independent of the motion of the base. The holding station may have a grid type spacing and function as a secondary weave control grid.

The path and manipulations of the base 22 with the positional controller 54, the number of warp fibers 42 engaged by the warp fiber arms 26 when forming each pick, and the sequence of warp fiber arm movements may be designed and pre-planned in a software model to produce the woven structure 14 having the desired contours. A stable shape is obtained by the interplay of fiber forces and friction within the textile unit cells throughout the component.

The software model may utilize as inputs: a CAD definition of the surfaces of a desired component incorporating the woven structure; a definition of the initial warp fibers' lengths, locations, and orientations; and a definition of a textile repeating unit cell (or pick). The software calculates motions of the wand 18, base 22, warp fiber arms 26 and optionally the weave control grid necessary to achieve desired contours in the woven structure 14, without colliding into each other. The software model is then used as input for the positional controllers 46, 50, 54, and optional weave control grid positional controller and control of the fill fiber wand.

Separation S1 and separation S2 between warp fibers can be adjusted to adjust the shape of the woven structure 14. The separations S1 and S2 may remain relatively consistent when forming the area shown in FIG. 6. The separations S1 and S2 may be gradually increased after each pass of the fill fiber 30 to create a flanged area of the woven structure 14 shown in FIG. 5.

Figure 10:
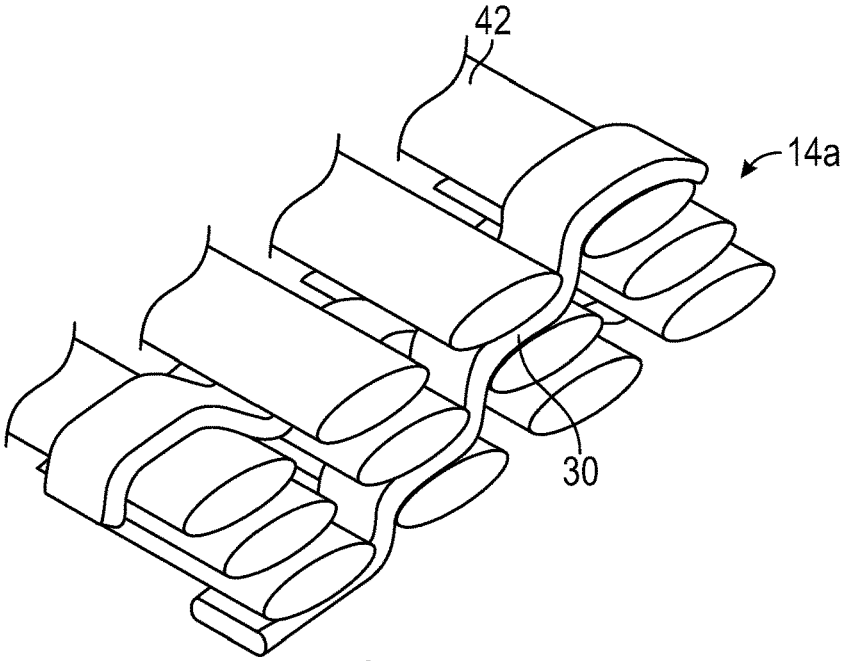
FIG. 10 shows a close-up view of a woven structure having multiple layers.

Referring to FIG. 10, in some examples a woven structure 14*a* may include multiple layers of the warp fibers 42. The fill fiber 30 joins all three layers in this example. When weaving the woven structure 14 the warp fiber arms may selectively engage one, two, or more warp fibers.

Features of the disclosed method and assembly include a relatively precise and repeatable mechanized process that is conducive to high volume production of complex shape engine components with precise and repeatable introduction of warp fibers as the woven structure evolves.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A weaving method comprising placing a first section of a fill fiber between warp fibers, forming a pick, moving a base to reposition the warp fibers, and placing a second section of the fill fiber between the warp fibers to form a woven structure, wherein at least a portion of the warp fibers are introduced to the woven structure using a weave control grid;

wherein the weave control grid is slidably located below the fill fiber;

wherein the weave control grid has an open central section and a plurality of warp fiber openings surrounding the open central section, the plurality of warp fiber openings including openings for warp fibers to be added during changes in contour or size of the woven structure.

2. The weaving method of claim 1, wherein at least a portion of the warp fibers are secured to the base.

3. The weaving method of claim 1, wherein the weave control grid is affixed to the base.

4. The weaving method of claim 1, wherein the weave control grid is modular to permit changes to the size and shape of the open central section to accommodate changes in the size and shape of the evolving woven structure.

5. A weaving method comprising forming a first pick, repositioning warp fibers by moving warp fiber arms relative to a fill fiber wand, or repositioning warp fibers by moving the base relative to the fill fiber wand, or both and forming a second pick after repositioning warp fibers to produce a woven structure, wherein at least a portion of the warp fibers extend from one of the warp fiber arms to the base and at least a portion of the warp fibers are introduced to the woven structure using a weave control grid;

wherein the weave control grid is slidably located below the fill fiber wand;

wherein the weave control grid has an open central section and a plurality of warp fiber openings surrounding the open central section, the plurality of warp fiber openings including openings for warp fibers to be added during changes in contour or size of the woven structure.

6. The weaving method of claim 5, further comprising repositioning the weave control grid relative to the fill fiber wand.

7. The weaving method of claim 5, wherein warp fibers are positioned by the weave control grid prior to forming the first pick or second pick.

8. The weaving method of claim 5, wherein the weave control grid is modular to permit changes to the size and shape of the open central section to accommodate changes in the size and shape of the evolving woven structure.

9. A weaving assembly comprising a base, a base positional controller, a weave control grid, warp fiber arms, a warp fiber arm positional controller and a fill fiber wand;

wherein the weave control grid is slidably located below the fill fiber wand;

wherein the weave control grid has an open central section and a plurality of warp fiber openings surrounding the open central section, the plurality of warp fiber openings including openings for warp fibers to be added during changes in contour or size of a woven structure.

10. The weaving assembly of claim 9, further comprising a holding station.

11. The weaving assembly of claim 10, wherein the holding station is a secondary weave control grid.

12. The weaving assembly of claim 9, wherein the weave control grid is modular to permit changes to the size and shape of the open central section to accommodate changes in the size and shape of the evolving woven structure.

13. The weaving assembly of claim 9, wherein the weave control grid location is controlled by a positional controller.

14. The weaving assembly of claim 9, wherein the weave control grid is modular.

15. The weaving assembly of claim 9, wherein the weave control grid has openings with variable spacing between openings.

16. The weaving assembly of claim 9, further comprising additional weave control grids.

* * * * *